US006390321B1

(12) United States Patent
Wang

(10) Patent No.: US 6,390,321 B1
(45) Date of Patent: May 21, 2002

(54) GARBAGE CAN WITH A PUSH-OPEN CAP CONNECTED WITH A PEDAL INTERACTIVE DEVICE

(75) Inventor: Tin-Chou Wang, Tainan Hsien (TW)

(73) Assignee: Hwan Yih Enterprise Co., Ltd., Taipei Hsien (TW)

( * ) Notice: Subject to any disclaimer, the term of this patent is extended or adjusted under 35 U.S.C. 154(b) by 0 days.

(21) Appl. No.: 09/635,921

(22) Filed: Aug. 10, 2000

(51) Int. Cl.[7] ..... B65D 43/22; B65D 43/26; B65F 1/16

(52) U.S. Cl. ..... 220/264; 220/263; 220/825; 220/829; 220/908

(58) Field of Search ..... 220/263, 908, 220/254, 262, 264, 810, 825, 831, 832

(56) References Cited

U.S. PATENT DOCUMENTS 1,606,291 A * 11/1926 Burrows ..... 220/264
3,891,115 A * 6/1975 Ono ..... 220/263
4,765,548 A * 8/1988 Sing ..... 220/262
5,163,574 A * 11/1992 Sosan ..... 220/262
5,195,649 A * 3/1993 Wolters ..... 220/908
5,295,607 A * 3/1994 Chang ..... 220/263
5,372,271 A * 12/1994 Miller et al. ..... 220/263
5,671,859 A * 9/1997 Sheu et al. ..... 220/263
5,903,120 A * 5/1999 Shin ..... 220/263
6,209,744 B1 * 4/2001 Gill ..... 220/263

* cited by examiner

*Primary Examiner*—Lee Young
*Assistant Examiner*—Niki M. Eloshway
(74) *Attorney, Agent, or Firm*—Rosenberg, Klein & Lee

(57) ABSTRACT

A garbage cam with a push-open cap connected to a pedal interactive device includes a can body, a push-open cap pivotally connected to an inner side of an opening of a can cap, a torque spring to automatically push the push-open cap to move back to close the opening, and a pedal interactive device to pull open the push-open cap. The pedal interactive device consists of a pedal provided at a lower end of the can body, a rope having a first end fixed with the push-open cap and a second end wound around a rope wheel connected to a gear engaging a vertical rack positioned between an upper and a lower rib plates units. The rack is pushed up to rotate the gear and the rope wheel to wind the rope when a user steps down the pedal so that the push-open cap is pulled to open, and the push-open cap automatically moves to close up the opening when the user releases the pedal.

2 Claims, 6 Drawing Sheets

GARBAGE CAN WITH A PUSH-OPEN CAP CONNECTED WITH A PEDAL INTERACTIVE DEVICE

BACKGROUND OF THE INVENTION

This invention relates to a garbage can with a push-open can connected with a pedal interactive device, particularly to one with a pedal interactive device to push open a push-open cap, which is automatically closed if the pedal is released.

Garbage cans are widely used in public places and homes, having a wide variety of different styles, shapes and sizes to meet different uses. One conventional garbage can has a push-open cap for a person to push open to throw in garbage, and the cap automatically closes up, not permitting garbage to scatter around or bad odor to spread out to meet the demand of environment protection.

One common conventional garbage can with a push-open cap shown in FIG. 8 includes a can body 10 and a cap 20 closes an upper opening formed in a front side, a pivot 201 provided in an inner upper side of the opening for connecting a push-open cap 202, a torque spring 203 combined with the pivot 201. The torque spring 203 has a fix end 204 and an active end 205 respectively resting against the cap 20 and the push-open cap 202. Then a person pushes open the push-open cap 202 and throws garbage in the can body 10, and the push-open cap 202 automatically closes up when the hand of the person leaves the push-open cap 202 by means of resilience of the torque spring 203.

The conventional garbage can with a push-open cap utilizes the torque spring to automatically close the push-open cap, but the chances are that a user's hand may be clamped when the user retreats slowly the hand after throwing garbage, as the push-open cap quickly closes up. In addition, in pushing open the push-pen cap, a user's hand has to directly touch the cap, which may often not be so clean to cause fear of the user.

SUMMARY OF THE INVENTION

The objective of the invention is to offer a garbage can with a push-open cap connected with a pedal interactive device, wherein a push-open cap is pivotally connected in an inner side of an opening of a can cap, possible to close; automatically by means of a torque spring after pushed open. The push-open cap has a rope connected with an inner side, and the rope has one end extending out of the can cap wound around on a rope wheel of a pedal interactive device. Further, a gear is provided to connect the other side of the rope wheel, engaging a rack, which is pushed up by a push rod connected to and pushed up by a pedal positioned at a lower end of the can body. When a user steps down the pedal, the rack is moved up to rotate the gear and the rope wheel to wind the rope to pull open the cap. If the user releases the pedal, the cap will automatically close up. Opening the cap by stepping the pedal can avoid accidents of a user's hand being clamped by the cap of the conventional garbage can and a user's hand does not directly touch the cap in throwing garbage in.

The another feature of the invention is the pedal interactive device including a rope wheel and an engage groove formed at the other side of the rope wheel, a shell of the interactive device has threaded hole screwing with an adjust button. The other end of the adjust button is connected to a friction wheel possible to move in the engage groove to contact and rub with each other. If the adjust button is turned to loose or tighten, the friction wheel gradually separate from or moves near to contact the engage groove, permitting the rope wheel rotate with speed fast or slowly to let the cap close up in adjusting the speed of closing of the cap.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
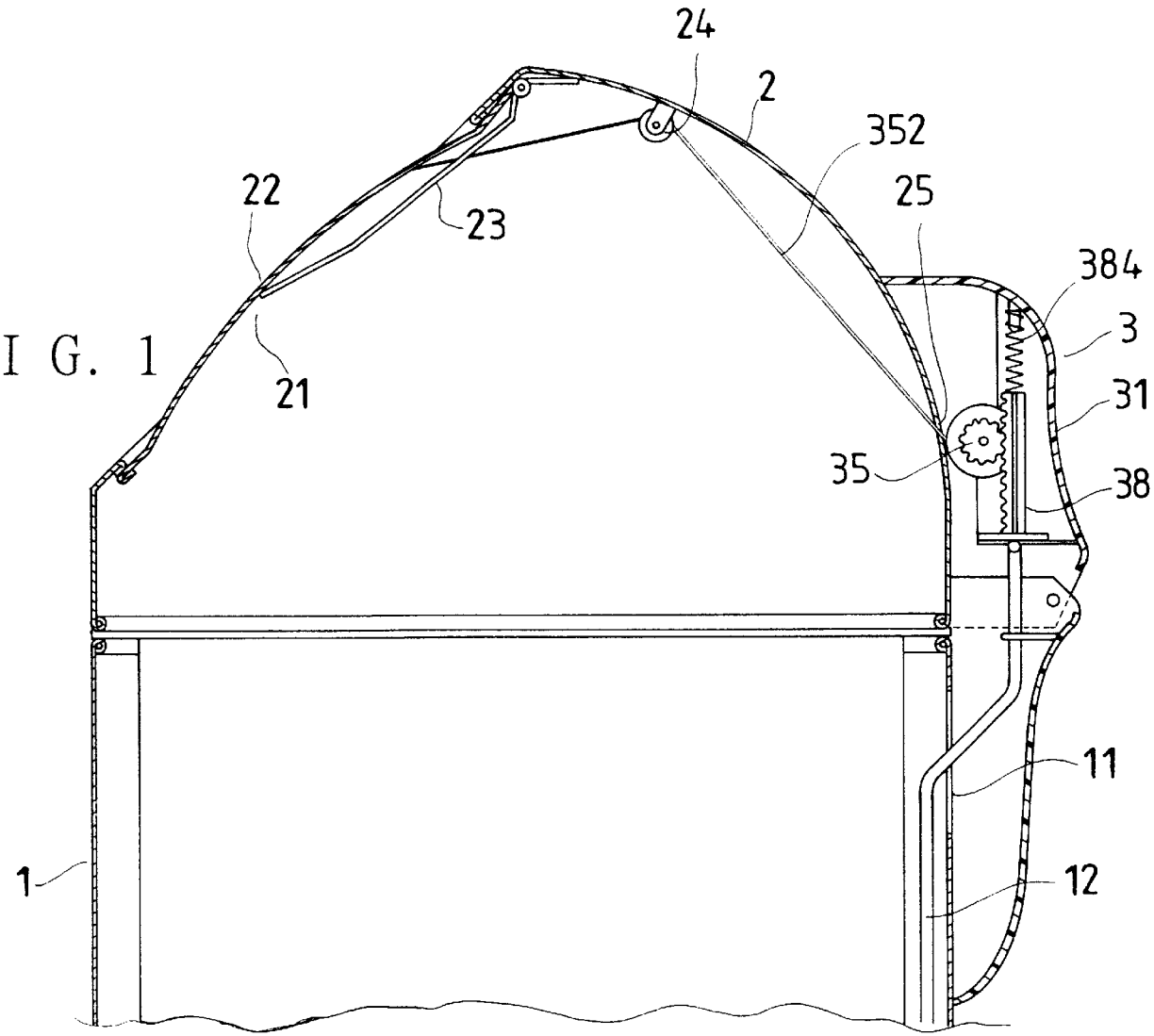
FIG. 1 is a cross-sectional view of a garbage can with a push-open can connected to a pedal interactive device of the present invention.

A preferred embodiment of a garbage can with a push-open cap connected to a pedal interactive device in the present invention, as shown in FIG, 1, includes a can body 1, a cap 2, and a pedal interactive device 3 as main components.

The can body 1 has a hole 11 in a circumferential wall for a push rod 12 to pass through to connect to a pedal (not shown in Figures) provided at a bottom. The push rod 12 is moved up in case of the pedal stepped down.

The cap 2 has a rear side pivotally connected to a top portion of the can body by means of a shell 31 of the pedal interactive device 3, lifted up for changing a garbage bag. The cap 2 further has an opening 21 in a front side, and a push-open cap 22 is pivotally connected inside the opening and attached with a torque spring 23 to elastically move the push-open cap 22 to close up the opening after the cap 22 is pushed open. Further, a pulley 24 is fixed in an inner upper surface of the push-open cap 22, and a hole 25 is bored in the rear side of the cap 2.

Figure 2:
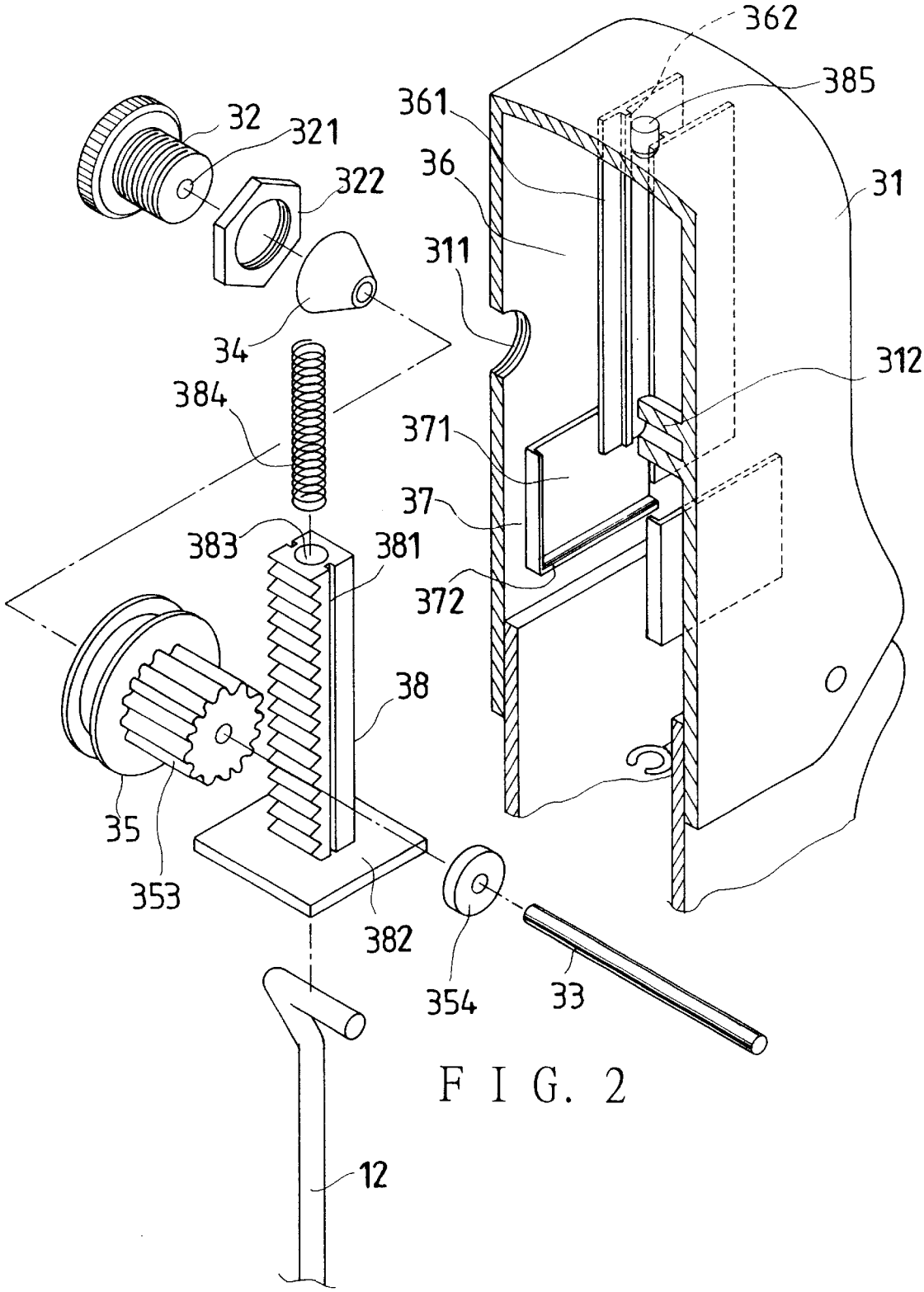
FIG. 2 is an exploded perspective view of the pedal interactive device of the present invention.
Figure 3:
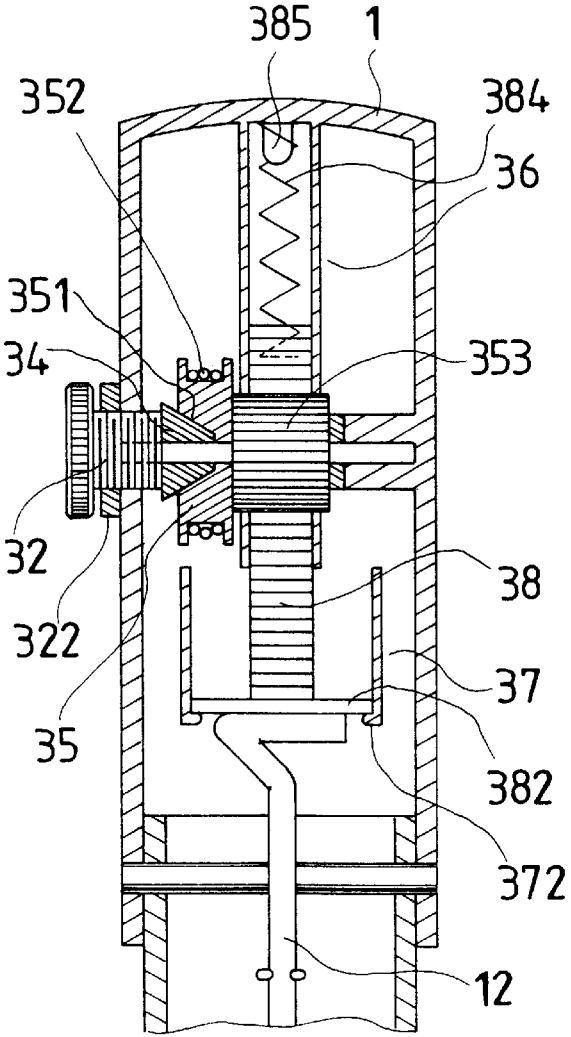
FIG. 3 is a. side cross-sectional view of the pedal interactive device of the present invention.

The pedal interactive device 3, as shown in FIGS. 2 and 3, has the shell 31 fixed with the rear side of the cap 2 and provided with a threaded hole 311 to screw with an adjust button 32. The adjust button 32 has a shaft hole 321 in the enter for a shaft 33 to pass through and to have its outer end fitting in a shaft base 312 formed on the other side of the shell 31, and a nut 322 screwing with the adjust button 32. Further, a friction wheel 34, a rope wheel 35 sand a washer 354 are orderly fitted around the shaft 33. The friction wheel 34 has a first end resting against the bottom end of the adjust button 32, and the rope wheel 35 has an engage groove 351 in the right side (in FIG. 3) for the friction wheel 34 to move in and contact with. A rope 352 is provided to wind around the rope wheel 35, with a first end passing through the hole 25 of the push-open cap 22 and extending around the pulley 24 and the bound tightly at the rear side of the push-open cap 22. Further, a gear 353 is connected to the other side of the rope wheel 35. The shell 31 has an upper rib plate unit 36 and a lower rib unit 37 provided in its Interior, and a vertical rack 38 is provided between the upper and the lower rib plate unit 36 and 37, engaging the gear 353 of the rope wheel 35, and the two side rib plates 361 of the upper rib plate unit 36 respectively have a vertical guide rail 362 to face each other, and the rack 38 has a guide groove 381 each in two sides to fit in the guide rails 362 to guide the rack 38 to move up and down. Further, the rack 38 has its lower end fixed on a base plate 382 just contained in the upper rib plate unit 37, and able to be pushed up by the push rod 12 of the can body 1 and making the rope wheel 35 engaging the rack 38 rotate. Next, the two rib plates 371 of the lower rib plate unit 37 have a limit edge 372 formed inward at a lower end, as shown in FIG. 3, to prevent the rack 38 from falling down. On an upper side of the rack 38 is provided a recess hole 383 for a lower end of a coil spring 384 to fit therein. An upper end of the coil spring 384 fits around a position rod 385 on an inner topside of the shell 31, elastically forcing the rack 38 downward.

Figure 4:
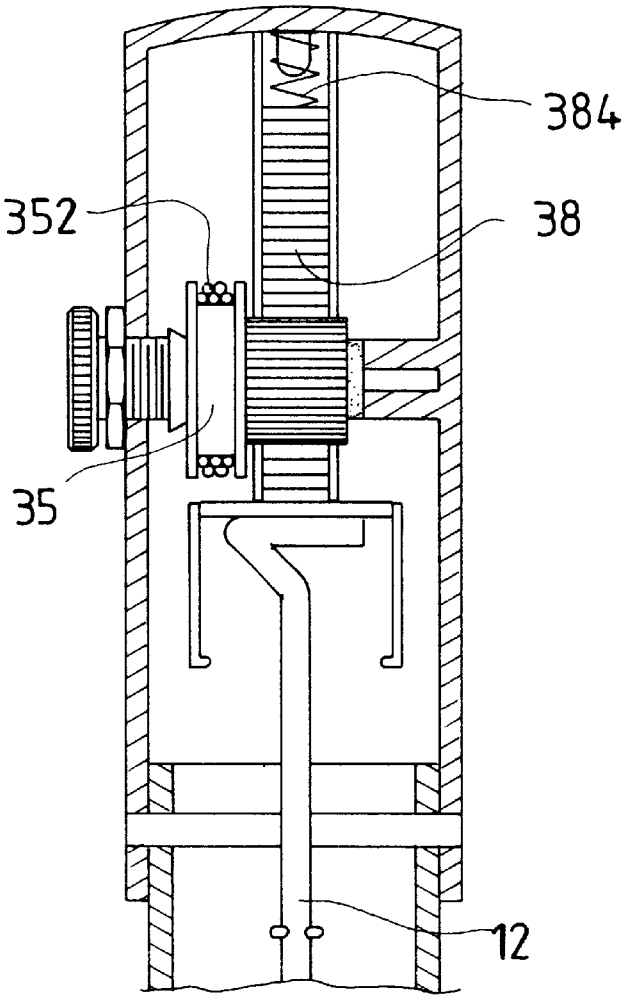
FIG. 4 is a side cross-sectional view of a rack of the pedal interactive device moving up of the present invention.
Figure 6:
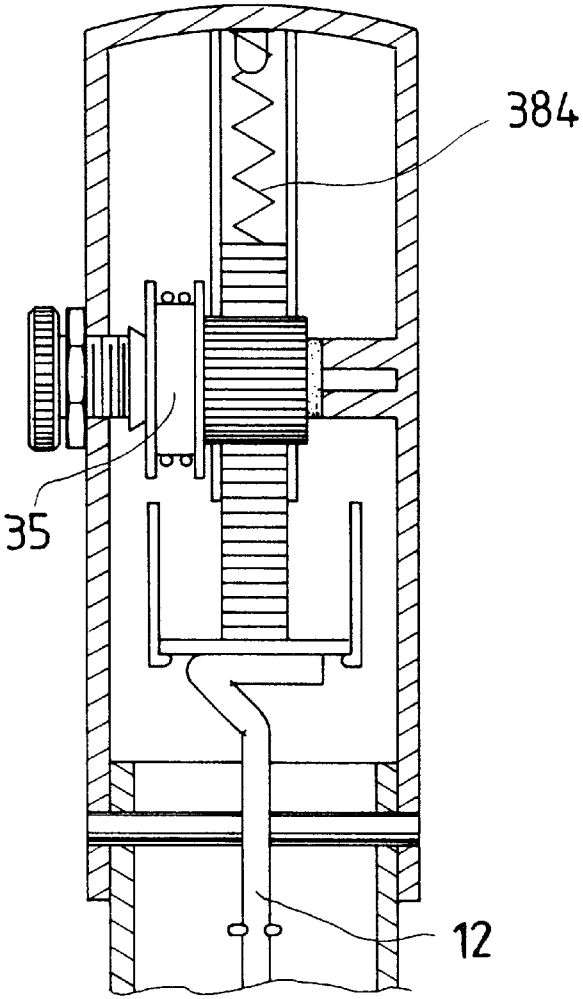
FIG. 6 is a side cross-sectional view of the rack moving down of the present invention.
Figure 5:
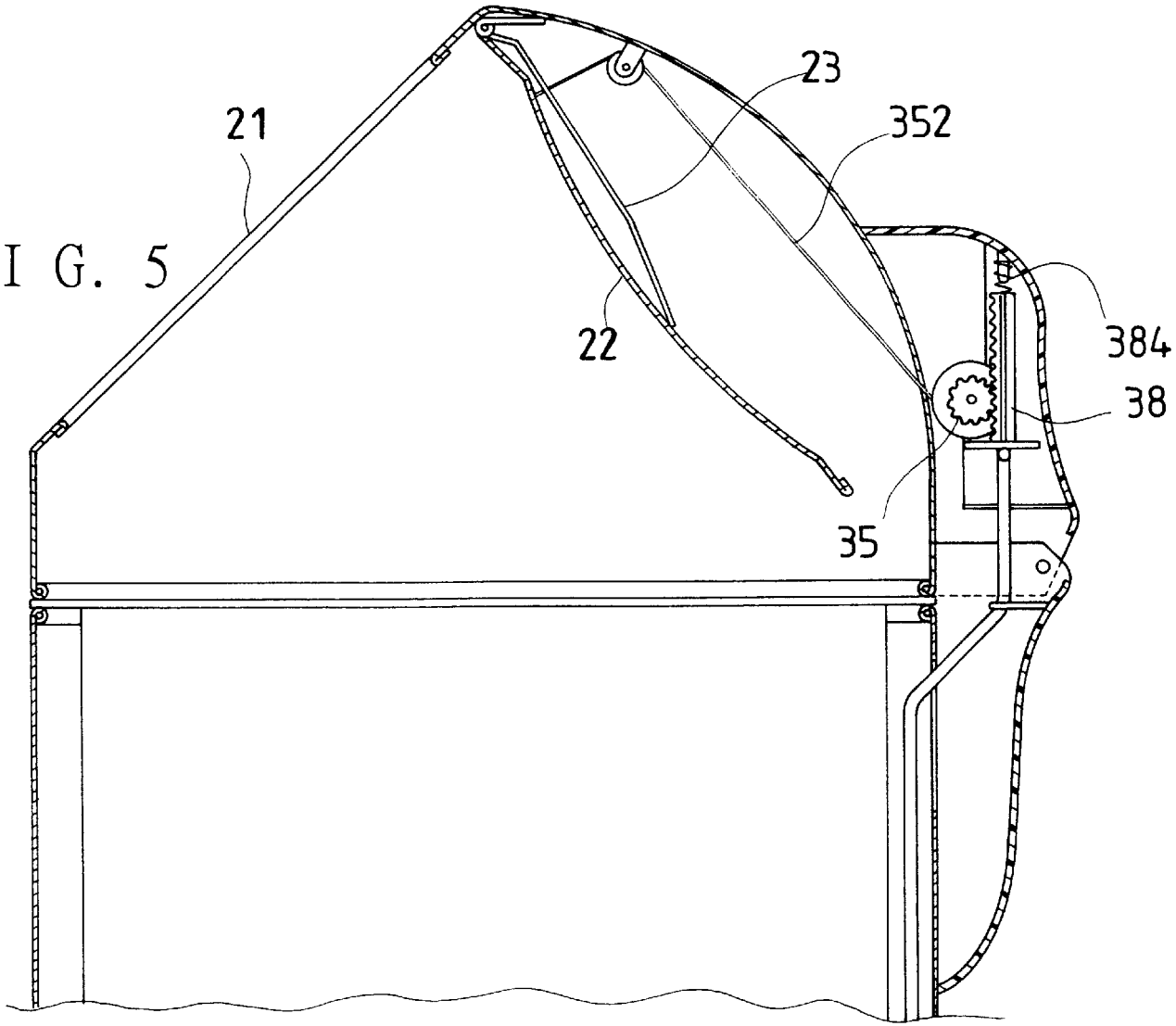
FIG. 5 is a cross-sectional view of the garbage can in operating condition of the present invention.
Figure 8:
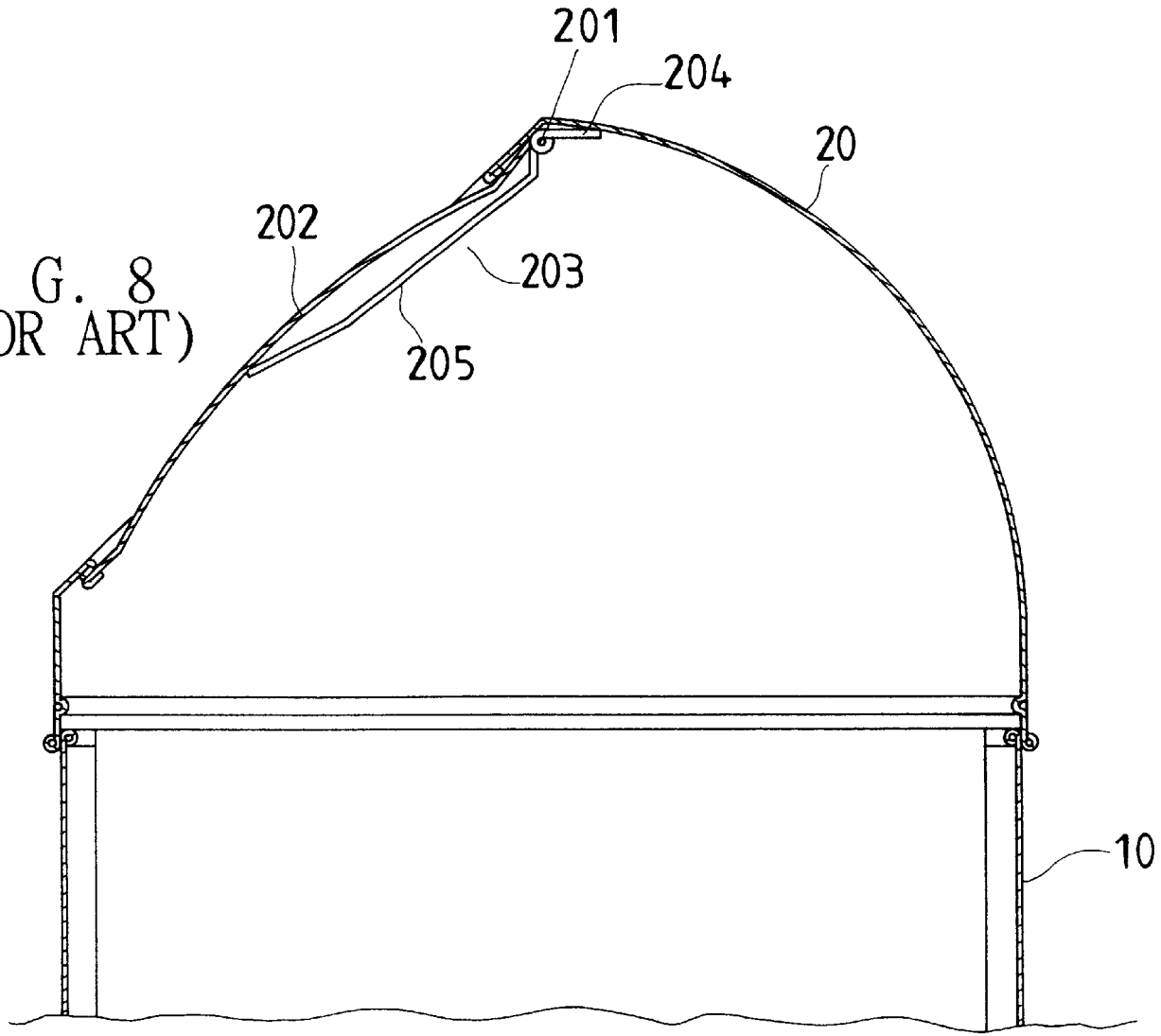
FIG. 8 (PRIOR ART)
FIG. 8 is a cross-sectional view of a known conventional garbage can.

In using, when a user throws garbage into the garbage can, he/she steps down the pedal at the lower end of the can body 1, with push rod 12 pushed up to subsequently move up the rack 38 between the upper and the lower rib plates units 36 and 37, as shown in FIG. 4. Then the rope wheel 35 winds the rope 352,which then pulls the push-open cap 22 open rearward as shoos in FIG. 5, and the user can throw garbage through the opening 21 into the can body 1. When the user releases the pedal, the push-open cap 2 will automatically move to close up the opening 21 by means of resilience of the torque spring 23. During movement of the push-open cap 22 recovering its position, the rope 352 is pulled together with the push-open cap 22, with the rope wheel 35 rewinding the rope to let the rack 38 engaging the gear 353 move down as shown in FIG. 6, ready for next movement.

Figure 7:
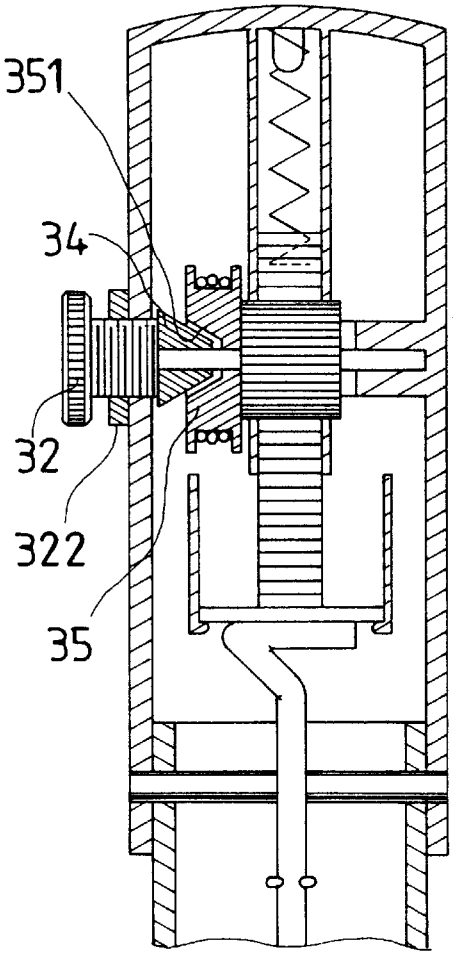
FIG. 7 is a side cross-sectional view of a friction wheel of the pedal interactive device in operating condition of the present invention.

Next, if the user wants to change the speed of closing movement of the push-open cap 22 over the opening 21, he/she can handle the adjust button 32 to attain the objective. When the adjust button 32 is rotated to push the nut 322 tightly as shown in FIG. 3, the friction wheel 34 moves toward the engage groove 351 of the rope wheel 35 and presses against the inner wall of the engage groove 351. At this time the push-open cap 22 moves back to pull the rope 352 and the rope wheel rewinds so that friction between the friction wheel and the engage groove 351 can change the revolving speed of the rope wheel 35, slowing releasing the rope 352, letting the push-open cap 22 slowly moves back to close the opening 21. On the contrary, as shown in FIG. 7, if the adjust button 32 is rotate to loosen the nut 322, the friction wheel 34 moves outward to gradually separate from the engage groove 351 of the rope wheel 35, permitting the rope wheel rotate more quickly to let the push-open cap 22 move back fast to close the opening 21.

The invention has the following advantages, as understood from the aforesaid description.

1. As the push-open cap is pushed open by the pedal stepped down, accidents of clamping a hand of a user happening in using the conventional garbage can never occur to that in the invention.
2. As the push-open cap is pushed open by the pedal stepped down, a user's hand does not directly tough the cap, without fear of the hand being smeared or stained.
3. The moving speed of the push-open cap can be adjusted so as to prevent it from moving back too quickly to give out loud noise to collide with the can cap, resulting in a long service span. While the preferred embodiment of the invention has been described above, it will be recognized and understood that various modifications may e made therein and the appended claims are intended to cover all such modifications that may fall within the spirit and scope of the invention.

What is claimed is:

1. A garbage can with a push-open cap connected to a pedal interactive device, comprising:

a can body;

a can cap combined at an upper side of said can body;

a push-open cap pivotally connected to an inside of an opening of said can cap, said push-open cap being moved back to close said opening by means of a torque spring after being pushed open; and, said pedal interactive device being coupled to said push-open cap, said pedal interactive device including:

(a) a pedal mounted at a lower end of said can body, (b) a push rod having a first end coupled said pedal for displacement responsive to displacement of said pedal, (c) a rack disposed at a second end of said push rod and displaced thereby, (d) a gear engaged with said rack to be rotate responsive to displacement of said rack, (e) a rope wheel located at a rear side of said can cap, said rope wheel being connected to said gear for rotation therewith, and (f) a rope having a first end secured to an inner surface of said push-open cap and a second end coupled to said rope wheel, said rope wheel winding said rope to pull open said push-open cap when a user steps down on said pedal, said push-open cap automatically moving back to close up said opening when the user releases said pedal, wherein said pedal controls movement of said push-open cap of said garbage can.

2. A garbage can with a push-open cap connected with a pedal interactive device, comprising:

a can body;

a can cap combined at an upper side of said can body;

a push-open cap pivotally connected to an inside of an opening of said can cap, said push-open cap being moved back to close said opening by means of a torque spring after being pushed open; and, said pedal interactive device being coupled to said push-open cap, said pedal interactive device including:

(a) a pedal mounted at a lower end of said can body, (b) a push rod having a first end coupled said pedal for displacement responsive to displacement of said pedal, (c) a rack disposed at a second end of said push rod and displaced thereby, (d) a gear engaged with said rack to be rotate responsive to displacement of said rack, (e) a rope wheel located at a rear side of said can cap, said rope wheel being connected to said gear for rotation therewith, (f) a rope having a first end secured to an inner surface of said push-open cap and a second end coupled to said rope wheel, said rope wheel winding said rope to pull open said push-open cap when a user steps down on said pedal, said push-open cap automatically moving back to close up said opening when the user releases said pedal, wherein said pedal controls movement of said push-open cap of said garbage can, (g) a shell coupled to said can cap, said shell having a threaded hole formed in one side thereof and a shaft base on an opposing side, (h) a shaft having one end disposed in said shaft base and supporting said rope wheel thereon, (i) an adjust button threadedly engaged with said threaded hole of said shell, said adjust button having a shaft hole for receiving an end of said shaft and a nut threadedly engaged with said adjust button, and (j) a friction wheel having a first side resting against a bottom end of said adjust button, said rope wheel having a first side surface provided with an engage groove for said friction wheel to be moved into contact therewith to thereby adjust a revolving speed of said rope wheel and subsequently a speed of opening said push-open cap.

* * * * *